US005210542A

United States Patent [19]

Pett et al.

[11] Patent Number: 5,210,542

[45] Date of Patent: May 11, 1993

[54] MICROSTRIP PATCH ANTENNA STRUCTURE

[75] Inventors: Todd A. Pett, Longmont; Steven C. Olson, Broomfield, both of Colo.

[73] Assignee: Ball Corporation, Muncie, Ind.

[21] Appl. No.: 725,333

[22] Filed: Jul. 3, 1991

[51] Int. Cl.[5] ..... H01Q 1/38

[52] U.S. Cl. ..... 343/700 MS; 343/757; 343/763

[58] Field of Search ..... 343/700 MS, 757, 878, 343/879, 882, 761, 766, 758, 763

[56] References Cited

U.S. PATENT DOCUMENTS

| | | | |
|---|---|---|---|
| 3,259,727 | 7/1966 | Casler | 200/155 |
| 4,131,894 | 12/1978 | Schiavone | 343/700 |
| 4,170,013 | 10/1979 | Black | 343/700 |
| 4,369,447 | 1/1983 | Edney | 343/769 |
| 4,614,947 | 9/1986 | Rammos | 343/778 |
| 4,626,865 | 12/1986 | Rammos | 343/786 |
| 4,792,810 | 12/1988 | Fukuzawa et al. | 343/778 |
| 4,990,926 | 2/1991 | Otsuka et al. | 343/700 MS |

FOREIGN PATENT DOCUMENTS

| | | | |
|---|---|---|---|
| 0166807 | 10/1983 | Japan | 343/700 MS |
| 0140802 | 6/1989 | Japan | 343/700 MS |

*Primary Examiner*—Rolf Hille
*Assistant Examiner*—Hoanganh Le
*Attorney, Agent, or Firm*—Gilbert E. Alberding

[57] ABSTRACT

A microstrip patch antenna structure is disclosed having increased bandwidth and reduced coupling while maintaining low profile capabilities. The structure includes a support member having an isolating recess in which an electromagnetically coupled patch pair of antenna elements is positioned, the upper element being substantially flush with the surface of the support member surrounding the recess. To enhance isolation of the elements, the recess walls and the support surface are preferably electrically conductive and connected to ground. Also preferably, the lower element is connected to a microstrip transmission line, coplanar with the lower element and suspended within an isolating channel through the support member. In one aspect of the invention, a transition means is interposed between the transmission line and a connector, which connects the support member to a transmitter/receiver, to permit relative rotation therebetween. The transition means can also include means for capacitively coupling the transmission line with the connector.

29 Claims, 9 Drawing Sheets

Source: RHCP
O dBic level= -21.3 dB
$\theta$ = variable
$\phi$ = O degrees

Source : RHCP
0 dBic level = −21.5 dB
$\theta$ = 30 degrees
$\phi$ = variable

MICROSTRIP PATCH ANTENNA STRUCTURE

TECHNICAL FIELD OF THE INVENTION

This invention relates to a microstrip patch antenna structure and more particularly to a low profile, broadband microstrip patch antenna structure having diverse applications and reduced coupling.

BACKGROUND OF THE INVENTION

Antennas have evolved in a wide variety of types, sizes and degrees of complexity. The application, including operating environment, for which an antenna is intended determines the characteristics which the antenna must have. For example, communication between two fixed ground stations is most readily accomplished by aiming the stations' respective antennas toward each other in a non-dynamic relationship. Space and weight may not be limiting factors. Linear polarization, narrow beamwidth and narrow bandwidth may be satisfactory.

A fixed ground station can also communicate with a geostationary or orbiting satellite by aiming the antenna at the satellite and maintaining such relationship. In both applications, circular polarization, broader beamwidth and broader bandwidth may be desirable or necessary. It may also be desirable that the antenna have a directed or "scanned" beam with a relatively broad bandwidth. Further, for many such uses, it may be desirable for the ground station to assume a low profile and, in fact, be concealable.

A mobile ground application generally imposes significant size and weight restrictions on the antenna. Further, it may be particularly desirable that the antenna be concealable and yet be capable of physical rotation in order to remain "locked" onto a satellite while the vehicle is in motion.

Microstrip patch antennas have frequently been used when size, weight and low profile are important factors. The bandwidth and directivity capabilities of such antennas, however, can be limiting for certain applications. While the use of electromagnetically coupled microstrip patch pairs can increase bandwidth, full realization of such benefit presents significant design challenges, particularly where maintenance of a low profile and broad beamwidth is desirable.

The use of an array of microstrip patches can improve directivity by providing a predetermined scan angle. However, utilizing an array of microstrip patches presents a dilemma: the scan angle can be increased if the array elements are spaced closer together, but closer spacing can increase undesirable coupling between antenna elements thereby degrading performance.

Furthermore, while a microstrip patch antenna is advantageous in applications requiring a conformal configuration, mounting the antenna presents challenges with respect to the manner in which it is fed such that conformality and satisfactory radiation coverage and directivity are maintained and losses to surrounding surfaces are reduced.

OBJECTS AND SUMMARY OF THE INVENTION

In view of the foregoing, it is an object of the present invention to provide a low profile antenna structure which can be adapted to diverse communication applications, such as ground-to-satellite. It is a further object to provide an antenna structure having relatively broad bandwidth and scan angle capabilities, and also having increased electromagnetic isolation of the elements and feed network to reduce undesired coupling. It is a further object to provide an antenna structure capable of physical rotation for increased coverage without complicated and lossy joints.

In accordance with the present invention, an antenna structure is provided having a support member, radiating means for transmitting/receiving radio frequency signals and feed means for conducting the radio frequency signals to/from the radiating means. The support member has an isolating recess in which the radiating means is disposed and an electrically conductive reference surface at the bottom of the recess. The radiating means comprises an electromagnetically coupled patch pair with a first patch element positioned above the reference surface and a second patch element substantially flush with the upper surface of the support member above the first patch element. Both the first and second patch elements are substantially parallel to the reference surface and do not contact any part of the support member, including the recess walls.

Preferably, the feed means includes an interface means connected to the support member and adapted for electrical innerconnection with a transmitter/-receiver means, and interconnect means supported by the support member, for electrically innerconnecting the radiating means with the interface means. Additionally, the antenna structure can include a transition means interposed between the interconnect means and the interface means for permitting relative rotation therebetween. Preferably, the transition means is also adapted for permitting capacitive coupling between the interconnect means and the interface means, including capacitive coupling of both the signal-carrying conductors and reference (ground) conductors of the interface means and the interconnect means.

The interconnect means can, for example, include a square-ax transmission network which comprises a microstrip transmission line suspended in an isolating channel within the support member. The transmission line is preferably substantially coplanar with the first patch element and is interconnected thereto.

The support member preferably includes upper and lower support members with a first insulating sheet positioned therebetween. The first patch element is disposed on the first insulating sheet and the second patch element is disposed on a second insulating sheet placed on the top surface of the upper support member. When a square-ax interconnect network is employed, the microstrip transmission lines are also disposed on the first insulating sheet; and the upper and lower support members each have opposing channel portions which, together, define the channel through which the microstrip transmission line is suspended.

To provide enhanced isolation of the EMCP elements, the walls of the recess in which the radiating means is disposed are preferably electrically conductive, as is the upper surface of the support member. Additionally, the outer aperture of the recess is preferably flared.

The sizes of the recess and first (or lower) patch element are jointly selected with the height of the lower patch element above the reference surface such that the height is less than the distance between the edge of the patch element and the recess wall. Similarly, the sizes of the recess (more preferably, the size of the flared aperture of the recess) and second (upper) patch element are jointly selected with the distance between the first and second patch elements such that the distance between the edge of the second patch element and the recess walls (or aperture) is greater than the distance between the two patch elements.

When the present invention is employed in an application in which an array of antenna elements is desired, the support member includes a plurality of recesses and an electrically conductive reference surface at the bottom of each. One pair of upper and lower patch elements is disposed within each recess and the pairs are interconnected with the interconnect network. The lengths of the transmission lines in the interconnect network can be selected such that the antenna structure exhibits a desired scan angle.

In operation, the interface means, having both a signal-carrying conductor and a reference conductor, is connected to a transmitter/receiver, also having signal-carrying and reference conductors. In the transmit mode of operation, a signal is conveyed from the transmitter through the interface means to the transition means. In one aspect of the present invention, the transition means capacitively couples both the signal-carrying conductor and the reference conductor of the transmission means with the signal-carrying conductor and reference conductor, respectively, of the interconnect means. Such capacitive coupling yields relatively low electrical noise, thereby enhancing performance of the antenna structure, and also provides a reliable transition when the interconnect means and the transmission means are rotatable relative to each other, such as in a scanned array antenna capable of tracking a communications satellite.

The signal to be transmitted is conveyed through the interconnect means to the radiating means. When a square-ax interconnect network is employed, the signal remains substantially isolated within the channels as it is conveyed to the driven element of the electromagnetically coupled patch pair(s). Thus, undesirable coupling between various transmission lines in the interconnect network between transmission lines and patch elements can be substantially reduced or avoided, thereby reducing overall size requirements. Furthermore, the signal is also substantially isolated from interference with outside sources which, in a like manner, are substantially isolated from signals within the square-ax network.

The signal is conveyed to the lower (driven) patch element which is electromagnetically coupled with the upper (parasitic) patch element, and is radiated by the pair. Preferably, the recess walls are electrically conductive and the upper surface of the support member is electrically conductive; and all of the electrically conductive surfaces, including the reference surface at the bottom of the recess, are connected to a reference potential (i.e., ground). Consequently, radiation which is emitted from the patch pair in directions other than through the recess aperture is substantially confined to the recess, thereby substantially isolating the patch pair from external interference, from radiation from the interconnect network and from radiation from adjacent patch pairs (in an array application). Similarly, such external elements are substantially isolated from radiation emitted from the patch pair, thereby allowing for high performance and accommodating size restrictions.

In summary, the present invention provides the technical advantage of having relatively broad bandwidth and reduced mutual coupling. The present invention also provides a low profile package adaptable for scanned array applications in which rotation of the radiating element is desirable.

BRIEF DESCRIPTION OF THE DRAWINGS

For a more complete understanding of the present invention, and the advantages thereof, reference will be made in the following description to the accompanying drawings, in which.

DETAILED DESCRIPTION OF THE INVENTION

The present invention is best understood by referring to FIGS. 1–11 of the drawings, like numerals being used for like and corresponding parts of the various drawings.

Figure 1:
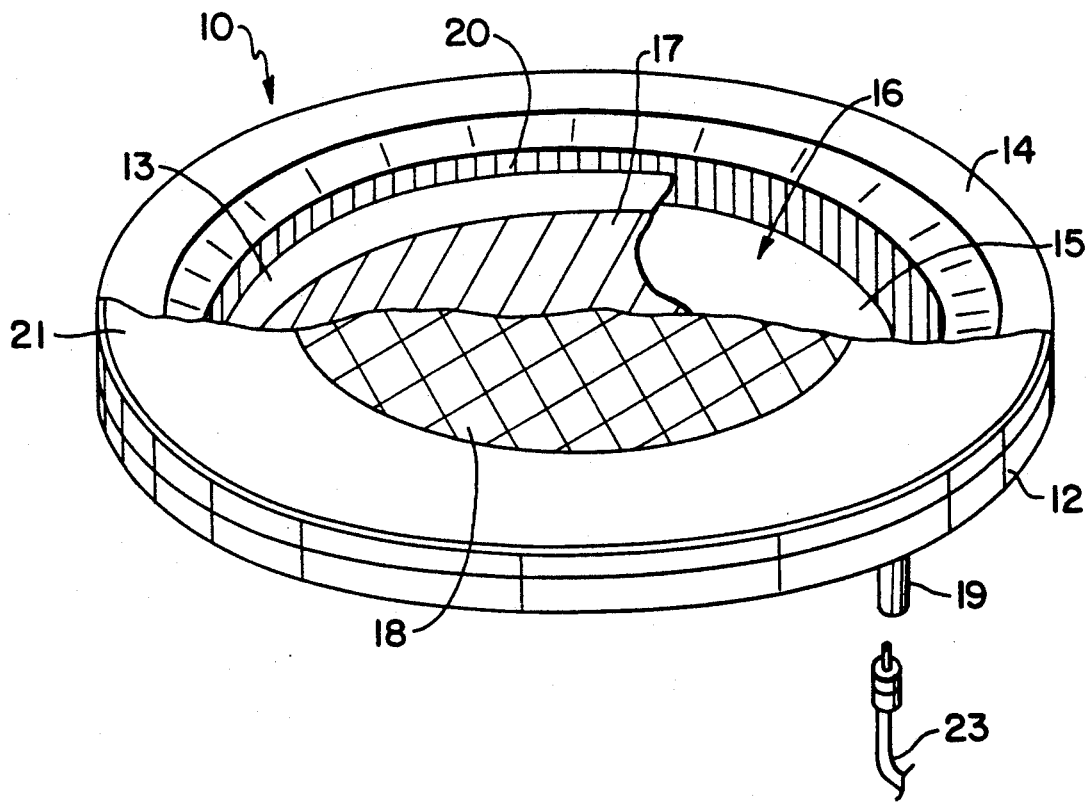
FIG. 1 is a perspective view of an embodiment of an antenna structure of the present invention having components partially cut away.
Figure 2:
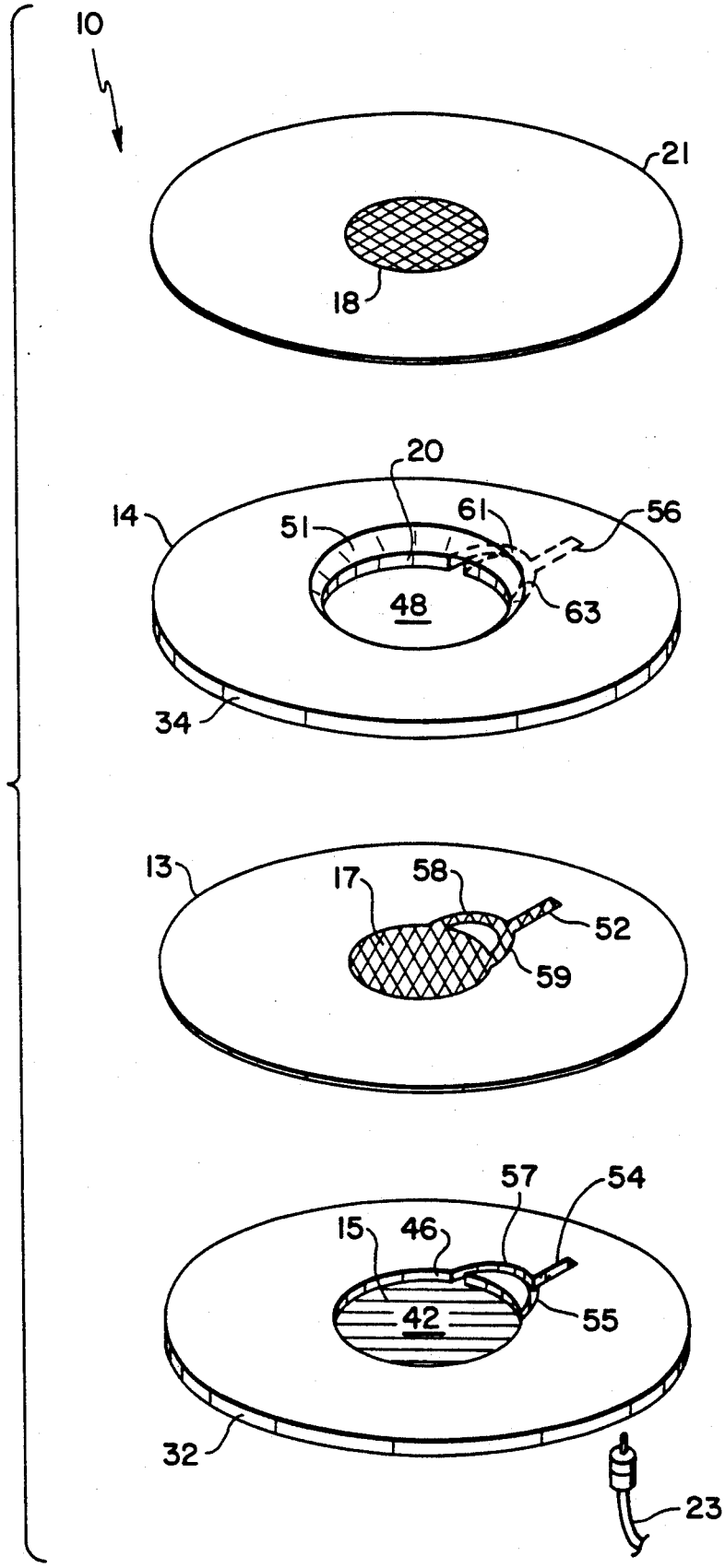
FIG. 2 is an exploded view of the embodiment of the antenna structure illustrated in FIG. 1.

FIGS. 1–5 illustrates an embodiment of an antenna structure 10 of the present invention. It includes a support member 12 having an upper surface 14 with an isolating recess 16 disposed therein and an electrically conductive reference surface 15 at the bottom of recess 16. As best shown in FIG. 2, support member 12 preferably comprises an upper support member 34 and a lower support member 32; and recess 16 is preferably defined by a recess 42 formed in lower support member 32 and an opening 48 formed through upper support member 34. Antenna structure 10 further includes a radiating means having an electromagnetically coupled patch pair (EMCP) of microstrip elements, namely, a lower, driven, microstrip patch element 17 and an upper, parasitic, microstrip patch element 18. Parasitic element 18 is disposed so that it is substantially flush with the region of upper surface 14 surrounding recess 16, but does not contact upper surface 14 or the inner surfaces 20 of recess 16. Driven element 17 is disposed within recess 16 above reference surface 15. It, too, does not contact the inner surfaces 20 of recess 16. Both parasitic and driven elements 18 and 17 are substantially parallel to reference surface 15. Parasitic element 18 can be disposed on a low-loss, insulating sheet 21 positioned on upper surface 14. Driven element 17 can similarly be suspended within recess 16 by disposing it on another low-loss, insulating sheet 13 positioned within recess 16 between upper and lower support members 34 and 32. The spaces between parasitic and driven elements 18 and 17 and between element 17 and reference surface 15 serve as dielectric layers 31 and 33, respectively, and can be air or can be filled with a dielectric material, preferably having a higher dielectric constant than air (such as a polyurethane foam).

The EMCP pair 17 and 18 transmits or receives radio frequency (RF) signals from or to a radio means, that is a transmitter and/or receiver, depending upon the application, by way of a feed means which includes an interface, such as a coaxial connector 19, to connect support member 12 with a transmission line or cable 23 coupled to the transmitter/ receiver. As will be discussed in more detail, an interconnect line 52 connects EMCP pair 17 and 18 to coaxial connector 19.

To provide enhanced isolation for EMCP pair 17 and 18, the surfaces of upper and lower support members 34 and 32, including inner surface 46 of recess 42 and inner surfaces 20 and 51 of opening 48, are preferably electrically conductive and are at the same electric potential as reference surface 15, thereby forming a ground reference below and around EMCP pair 17 and 18 to substantially isolate and shield it from nearby electromagnetic fields and to substantially prevent electromagnetic radiation from EMCP pair 17 and 18 from interfering with nearby fields. To provide such electrically conductive surfaces, upper and lower support members 34 an 32 can be formed of an electrically conductive material, such as aluminum, or can be formed of a nonconductive material, such as plastic or structural foam, with the surfaces of upper and lower support members 34 and 32 and reference surface 15 being disposed thereon, such as with metallic plating or conductive paint. Upper and lower support members 34 and 32 can be electrically connected by selecting the size of lower insulating sheet 13 such that it is smaller than upper and lower support members 34 and 32, thereby enabling upper and lower support members 34 and 32 to be in electrical contact with each other. It can be appreciated that other means can be used for electrically connecting the electrically conductive surface.

The area of upper surface 14 which surrounds recess 16 is preferably relatively planar to increase the uniformity of (or reduce distortions to) the radiation pattern of antenna structure 10. The upper edge of opening 48 preferably has a flared aperture 51, a feature which has also been found to enhance the performance of antenna 10 (e.g., beam directivity, reduced coupling). Although recess 16 and EMCP pair 17 and 18 are illustrated in FIG. 1 as being circular in shape, they are not limited to being any particular shape but may have any number of other shapes. Driven and parasitic elements 17 and 18 are both preferably about one-half wavelength elements (facilitating design and production, particularly when circular polarization is employed) but are not limited to such size.

The diameter of the upper end of opening 48 should be large enough for parasitic element 18 to be positioned without coming into contact with any of the conductive surfaces of upper support member 34 or opening 48. If the distance between the outer edge of parasitic element 18 and the inner edge of opening 48 is too small, electromagnetic coupling between the two can occur which changes the resonant frequency of parasitic element 18 and reduces the efficiency of antenna structure 10. Increasing the separation distance reduces such coupling but, as can be appreciated, an excessive distance between the two can cause antenna structure 10 to take up unnecessary space. Similarly, the diameter of recess 42 should be large enough for driven element 17 to fit within recess 42 without coming into contact with any of the conductive surfaces of lower support member 32 or recess 42 and should not be so small that the efficiency of antenna structure 10 is adversely affected. It has been found that spacing which may be desirable between parasitic element 18 and opening 48 is larger than spacing which may be desirable between driven element 17 and recess 42. The diameter of recess 42 can, therefore, be as large as the diameter of opening 48. However, it is preferable that recess 42 have a reduced diameter to increase the isolation of microstrip transmission line 52 by diminishing the amount which is exposed in recess 42. Flared aperture 51 makes the transition between the two diameters smoother and also tends to increase the isolation of parasitic element 18.

Use of an EMCP pair increases the bandwidth of antenna structure 10, with the bandwidth being determined in part by the thickness and dielectric constant of the material between elements 17 and 18 and between driven element 17 and reference surface 15. It has been found that the bandwidth of antenna structure 10 is also determined in part by the volume of recess 16. Consequently, employing recess 16 both increases the isolation of EMCP elements 17 and 18 and increases the bandwidth of antenna structure 10.

With particular reference to FIG. 1, it has also been found that the performance of antenna structure 10 is enhanced (e.g., antenna efficiency and bandwidth) when the distance $d_1$ from an edge of driven element 17 to wall 46 of recess 42 is greater than the distance $d_2$ between driven element 17 and reference surface 15. Similarly, it is preferable that the distance $d_3$ from an edge of parasitic element 18 to the upper edge of flared aperture 51 be greater than the distance $d_4$ between parasitic element 18 and driven element 17. Without wishing to be bound by any particular theory, it is believed that such an arrangement enables one or more radiating apertures to be defined between parasitic element 18 and driven element 17 and between driven element 17 and reference surface 15 rather than between driven element 17 and adjacent wall 46 and between parasitic element 18 and adjacent flared aperture 51.

In operation, a signal to be transmitted by antenna structure 10 is conveyed to driven element 17 by cable 23 and connector 19. (It will be appreciated that antenna structure 10 is equally capable of receiving signals and that the features and advantages of the present invention are not affected by the mode of operation). EMCP elements 17 and 18 radiate energy over a bandwidth which is, in part, determined by the thicknesses and dielectric constants of dielectric layers 31 and 33 within recess 16. The present invention employs an EMCP pair and a recess to increase bandwidth while also providing means to reduce attendant mutual coupling. Radiated energy generated by elements 17 and 18 within recess 16 which could adversely affect nearby circuitry or other antenna elements is substantially confined to the recess by the grounded surfaces of recess 16. Some of the energy from parasitic element 18 radiated away from support member 12 could similarly adversely affect nearby circuitry or other antenna elements; the positioning of parasitic element 18 substantially flush with the surrounding portion of surface 14 enables this latter radiation to be substantially dissipated to conductive surface 14. The substantially flush nature of parasitic element 18 also facilitates the low profile and the broad beamwidth of antenna structure 10. In a like manner, EMCP elements 17 and 18 are substantially isolated from radiation from external sources.

Thus, the use of EMCP elements 17 and 18 in recess 16 permits antenna structure 10 to exhibit increased bandwidth over other types of antennas while the use of isolating recess 16 and conductive surface 14 reduces accompanying undesirable mutual coupling from that frequently experienced by conventional EMCP antennas. Further, the foregoing benefits can be obtained without sacrificing desirable low profile characteristics.

Figure 3:
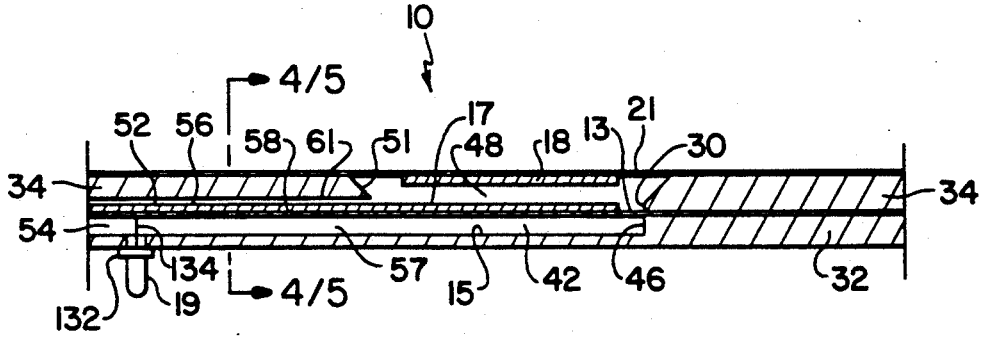
FIG. 3 is a cross-sectional view of a portion of the antenna structure illustrated in FIG. 1.

As noted, driven element 17 transmits or receives RF energy from or to a transmitter or receiver, depending upon the application. An interface means, such as coaxial connector 19 secured to the bottom of lower support member 32, is used to connect support member 12 to a transmission line or cable 23 coupled to the transmitter/receiver. As illustrated in FIG. 3, the outer shielding 132 of coaxial connector 19 is electrically connected to an electrically conductive surface of lower support member 32 which is electrically connected to the other electrically conductive surfaces of upper and lower support members 34 and 32 such that all such surfaces are maintained at a common reference voltage (e.g., ground) to provide substantial isolation for the EMCP pair.

In one aspect of the present invention, the signal-carrying inner conductor 134 of the coaxial connector 19 extends through lower support member 32 (without contacting any of the electrically conductive surfaces) and is secured (such as by soldering) to an interconnect means of a "square-ax" configuration which interconnects coaxial connector 19 with driven element 17. A square-ax transmission line includes an insulated, inner, signal-carrying conductor surrounded by an isolating "channel" shield through the support member which is connected to a reference voltage (e.g. ground).

The signal-carrying conductor of the square-ax transmission line employed in the present invention includes a microstrip transmission line 52 and a two-way polarizer comprising microstrip lines 58 and 59 of unequal lengths to obtain circular polarization, as desired. It will be appreciated that other techniques can be used to obtain circular polarization. Lines 52, 58 and 59 are disposed on the same surface of lower dielectric sheet 13 as driven element 17 and are coplanar therewith and connected thereto. The shielding portion of the square-ax transmission line includes lower channel portions 54, 55 and 57 disposed in the top of lower support member 32 and upper channel portions 56, 61 and 63 (shown in phantom) disposed in the bottom of upper support member 34. The use of two support members facilitates production by enabling upper and lower channel portions to be formed separately and permits a more complicated interconnect arrangement than would otherwise be possible.

The inner surfaces of channel portions 54, 55, 56, 57, 61 and 63 are electrically conductive to provide the desired shielding around lines 52, 58 and 59. Both lower channel portions 54, 55 and 57 and upper channel portions 56, 61 and 63 correspond generally in position and geometry to lines 52, 58 and 59 but are slightly wider to prevent lines 52, 58 and 59 from contacting any of the electrically conductive surfaces or channels. When lower insulating sheet 13 is secured between upper and lower support members 34 and 32, lower and upper channel portions 54, 55 and 57 and 56, 61 and 63, respectively, form a continuous channel in which lines 52, 58 and 59 are suspended. Thus, electromagnetic fields created around signal-carrying lines 52, 58 and 59 are substantially confined to the channels in which the lines are suspended. Additionally, lines 52, 58 and 59 are shielded from nearby fields.

As previously noted, a two-way polarizer comprising microstrip lines 58 and 59 can be employed to excite driven element 17 in two orthogonal modes, thus achieving circularly polarization. It can be appreciated that both left- and right-hand circular polarization can be accommodated. Additionally, linear polarization can be achieved by exciting driven element 17 directly from microstrip transmission line 52 without a two-way polarizer. The driven element can also be rectangular and two orthogonal modes can be excited by using a two-way polarizer coupled to adjacent sides of the patch or by exciting the patch at a corner; linear polarization can be provided by exciting the rectangular patch on one side.

Driven element 17 and lines 52, 58 and 59 can be disposed on lower insulating sheet 13 using conventional thin-film photo-etching techniques. For example, the top or bottom surface of lower insulating sheet 13 can be completely metallized using conventional thin-film deposition techniques and then unwanted metallization can be etched away leaving driven element 17 and lines 52, 58 and 59. Parasitic element 18 can also be disposed on the upper or lower surface of upper insulating sheet 21 using thin-film techniques. Alternatively, conventional thick-film silk-screening techniques can be used to provide the metallizations.

As an alternative to employing square-ax transmission lines, the inner signal-carrying conductor 134 of coaxial connector 19 secured to the bottom of lower support member 32 can extend through lower support member 32 (without contacting any electrically conductive surfaces) into recess 42 and be connected (such as by soldering) directly to driven element 17. If inner conductor 134 is connected to the center of driven element 17, a monopole radiation pattern results. It can be appreciated that other patterns will result when the connection is made at other locations on driven element 17. Outer shielding 132 of coaxial connector 19 is electrically connected to an electrically conductive surface of lower support member 32 to provide the reference voltage.

FIG. 3 is a cross-sectional view of a portion of antenna structure 10 of FIG. 1 to further illustrate the arrangement of the individual elements. In particular, parasitic element 18 is substantially flush with the region of upper surface 14 surrounding opening 48. Consequently, extraneous fields and radiation from parasitic element 18 are either substantially confined to opening 48 or are dissipated to ground by upper surface 14.

Figure 4:
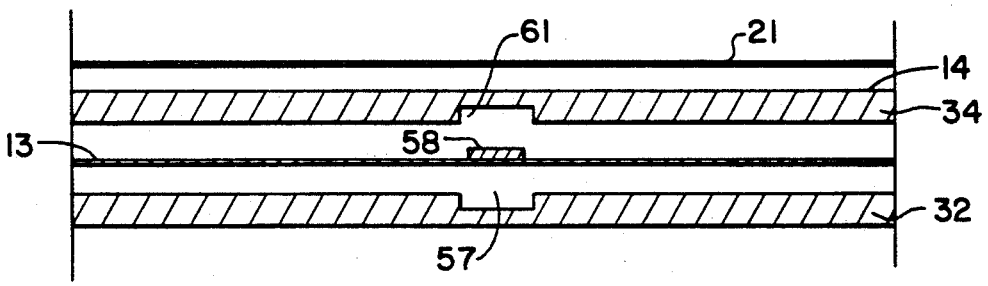
FIGS. 4 and 5 are exploded and assembled cross-sectional views, respectively, of portions of the antenna structure of FIG. 3 taken along axis in 4/5 - 4/5 in FIG. 3.
Figure 5:
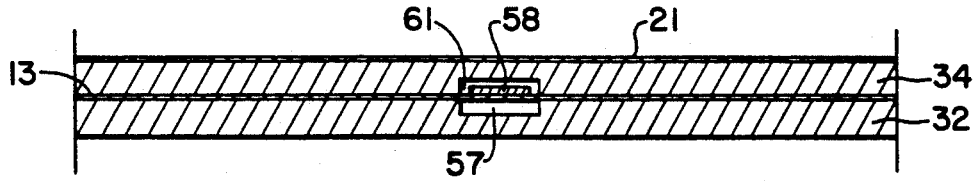

FIGS. 4 and 5 are exploded and assembled cross-sectional views, respectively, of a portion of antenna structure 10 taken along axis 4/5 - 4/5 of FIG. 3. They illustrate the manner in which microstrip transmission line 58 is suspended within an isolating channel comprising lower channel portion 57 and upper channel portion 61. Consequently, electromagnetic fields created around transmission line 58 are substantially confined to the channel defined by upper and lower channel portions 61 and 57 in which transmission line 58 is suspended.

In the embodiment illustrated, upper and lower channel portions 61 and 57 are each rectangular in cross-section; each may, however, have other cross-sectional geometries such as, for example, semi-circular. The channel must be large enough to prevent the microstrip transmission line from contacting any electrically conductive surface but should not be so large that it uses an excessive amount of space. It has also been found that enlarging the size of the channel results in a lower current density in the conductive walls contributing to lower losses and greater efficiency in antenna structure 10.

Figure 6:
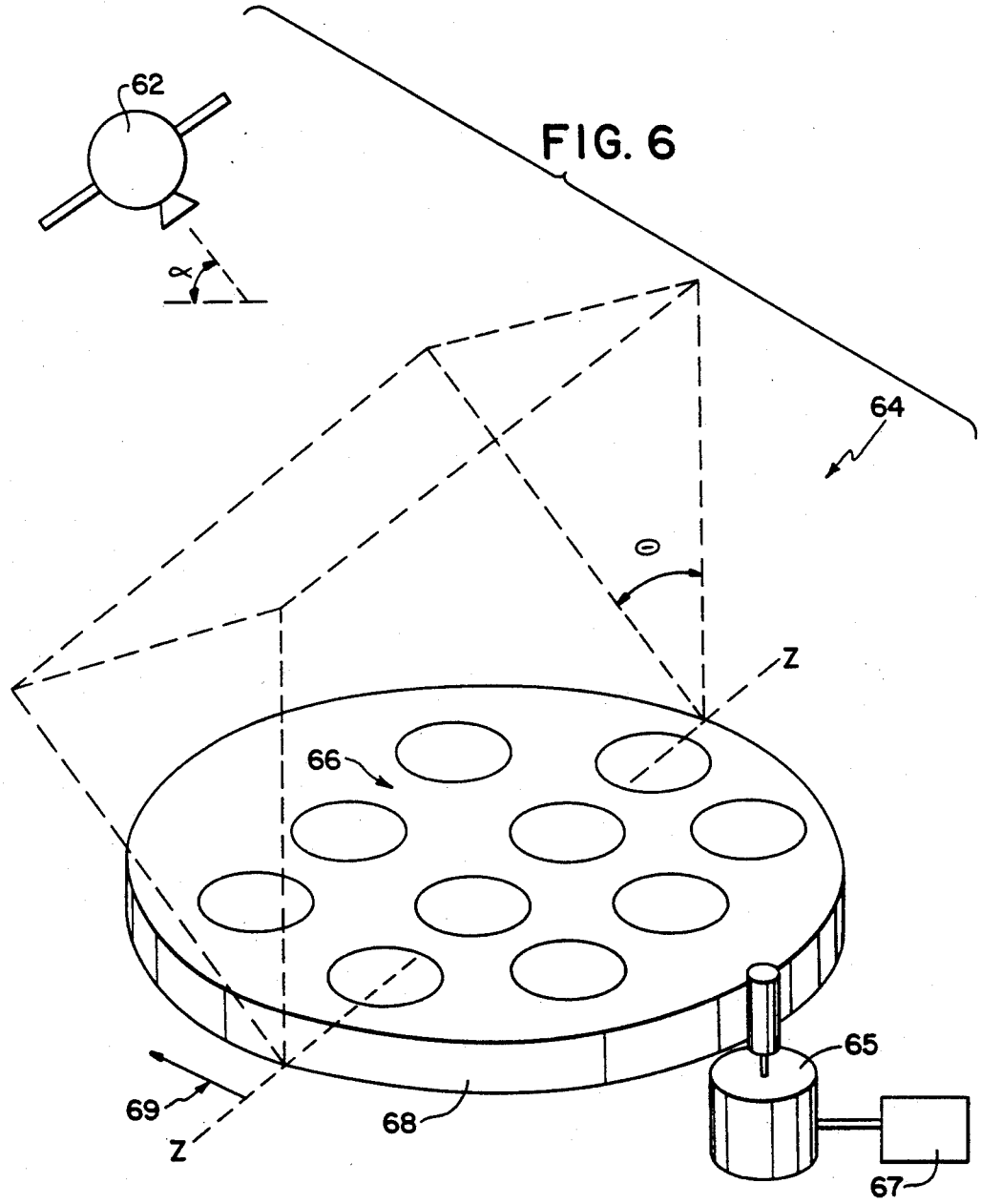
FIG. 6 is an illustration of an application the present invention in which a rotatable scanned array antenna is used to communicate with a satellite.

The benefits of the present invention are particularly realized in an array in which isolation of the radiating elements and interconnect network, the ability to track another station, and a low profile are especially important. FIG. 6 illustrates such an application in which a satellite 62 is in a geostationary orbit and positioned at an angle $\alpha$ relative to a specific region of the earth. A fixed ground station employing an antenna structure can often be aimed broadside at satellite 62 and fixed in that position to obtain satisfactory communication with satellite 62. However, in a mobile application, particularly one in which a low profile or concealable antenna is desired, continuous broadside tracking may be difficult as the vehicle changes locations. For such an application, the present invention can be configured into a scanned array antenna system, indicated as 64 in FIG. 6. A particular scan angle $\Theta$, providing a desired scan volume, can be obtained by appropriate selection of the number of antenna elements 66 in isolating recesses in the array, their arrangement on a support member 68, the spacing between them and their phasing relative to each other.

Figure 7:
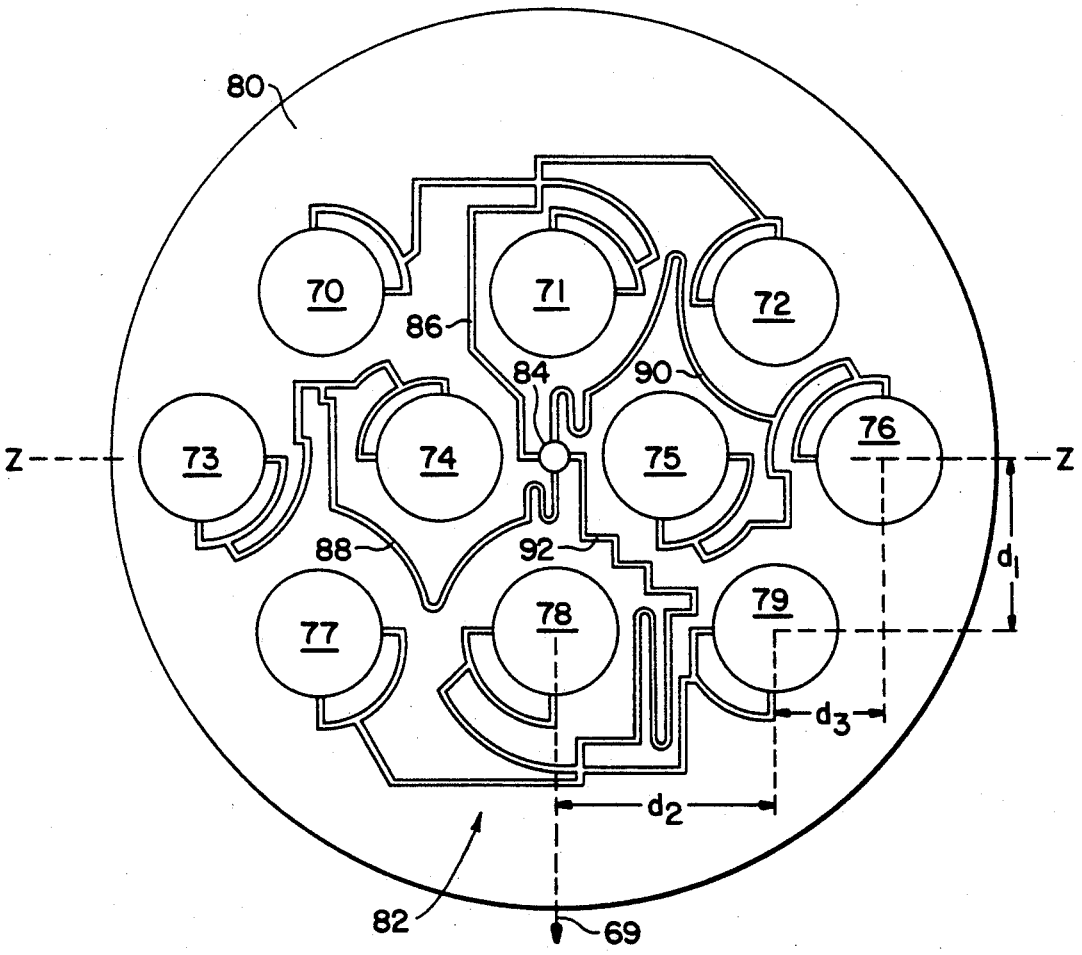
FIG. 7 is the layout of the driven elements and the interconnect network of the scanned array antenna of FIG. 6.

In the embodiment illustrated in FIG. 6 and detailed in FIG. 7, ten driven elements 70, 71, 72, 73, 74, 75, 76, 77, 78 and 79 are arranged to be symmetrical across an axis Z-Z which is perpendicular to the scanning direction, indicated by an arrow 69. As the vehicle on which antenna array 64 is mounted moves and changes its direction, support member 68 can be rotated about a center axis by a motor 65 under the control of a control module 67 in order to keep geostationary satellite 62 within the scan volume. Other conventional devices can be used to drive support member 68. As will be explained in detail in conjunction with FIG. 8, a transition means can be employed to couple an interconnect means, connected to antenna elements 66, with an interface means, including a coaxial connector to permit relative rotation between the interconnect means and the interface means. Alternatively, antenna array 64 can be electrically scanned when appropriate circuitry is employed.

FIG. 7 illustrates particular aspects of scanned array antenna 64 in more detail. Driven elements 70–79 are disposed on an insulating sheet 80, such as a thin Mylar sheet. The interconnect means includes an interconnect network 82 of microstrip transmission lines, also disposed on insulating sheet 80. The transition means includes a feed patch 84 positioned approximately in the center of insulating sheet 80 which couples driven elements 70–79 to the transmission means. Insulating sheet 80 is positioned on a lower support member and covered with an upper support member, the two support members together comprising support member 68, parasitic elements, which substantially correspond in shape and position to driven elements 70–79, are disposed on a second insulating sheet positioned above the upper support member. Channels are disposed in support member 68 which substantially correspond to the configuration of interconnect network 82 and result in a square-ax network in which the signal-carrying microstrip transmission lines of interconnect network 82 are enclosed within and isolated by the channels in support member 68.

Feed patch 84 is preferably soldered to the center conductor of a coaxial connector secured to the bottom of support member 68. The center conductor is disposed through the lower support member without contacting any of the electrically conductive surfaces of support member 68. These conductive surfaces are connected to the outer shielding of the coaxial connector thereby providing shielding for interconnect network 82.

To provide the scanning direction and angle illustrated in FIG. 6, interconnect network 82 includes: a first feed patch segment 86 connecting driven elements 70, 71 and 72 with feed patch 84; a second feed segment 88 connecting driven elements 73 and 74 with feed patch 84; a third feed segment 90 connecting driven elements 75 and 76 with feed patch 84; and, a fourth feed segment 92 connecting driven elements 77, 78 and 79 with feed patch 84.

Driven elements 70–79 are dual-fed in phase quadrature to excite orthogonal modes and obtain the circular polarization desired for ground-to-satellite communications. Additionally, the lengths of the microstrip transmission lines in each of first, second, third and fourth feed segments 86, 88, 90 and 92 differ in length to provide phase sifting of the signal supplied to the four groups of driven elements 70–72, 73 and 74, 75 and 76, and 77–79 relative to each other. Directional scanning results in the direction indicated by arrow 69.

One method for increasing scan angle 0 is to decrease the spacing d1 between adjacent radiating members in the scanning direction. A beneficial consequence of the reduced spacing is a reduction in grating lobes which tend to reduce the antenna's efficiency. However, decreasing spacing d1 increases the likelihood of undesirable coupling among adjacent radiating members and microstrip transmission lines. Decreasing the spacing may also make it more difficult to lay out interconnect network 82 between elements 70–79. Both of these problems can be partially alleviated by increasing the spacing d2 in the non-scanning direction between adjacent radiating members in the same row. Spacing d2 should not be increased so much, however, that excessive grating lobes adversely affect antenna performance. Spacing d3 in the non-scanning direction between radiating members in adjacent rows is preferably about one-half d2, providing a substantially uniform radiation pattern with satisfactory gain and reduced coupling in a given amount of space.

As previously detailed, the present invention reduces adverse mutual coupling while increasing bandwidth and substantially maintaining spacing to obtain a desired scan angle by disposing each radiating member in array antenna 64 in an isolating recess and by disposing interconnect network 82 in isolating square-ax channels. The electromagnetic fields created around transmission lines in interconnect network 82 are substantially confined to the isolating channels in which the lines are suspended. The electromagnetic fields created around and below each of driven patches 70–79 are substantially confined to the isolating recess in which each is located. And, extraneous fields and radiation from the parasitic patches are either substantially confined to the openings in support member 68 in which the patches are located or are substantially dissipated to ground by the electrically conductive upper surface of support member 68. Such an arrangement of recesses and channels also substantially shields the transmission lines of interconnect network 82 and the patch elements from nearby electromagnetic fields.

Furthermore, as with the embodiment of the present invention described in conjunction with FIGS. 2-5, the recesses in support member 68 of array antenna 64 can have flared apertures to reduce mutual coupling and to increase the isolation of portions of interconnect network 82.

It will be appreciated that other arrangements of antenna elements 66 are possible and that greater or fewer numbers of them can be used. For example, the gain of array antenna can be increased if a greater number of antenna elements 66 are used. If high gain is not required, a scan angle capability and bandwidth adequate for certain applications can be provided using as few as three antenna elements 66, thereby reducing the overall size of array antenna 64.

When antenna elements 66 are circular in shape, as illustrated in FIGS. 6 and 7, the layout of interconnect network 82 is facilitated. However, other shapes, such as rectangular, can also be used.

Because certain applications of the present invention require that it be exposed to the elements, a protective radome may be desired. To simplify construction and enhance performance, the upper parasitic patch(es) can be disposed on the inside surface of a close-fitting radome and still be located in a substantially flush position over the opening(s) in the support member.

Figure 8:
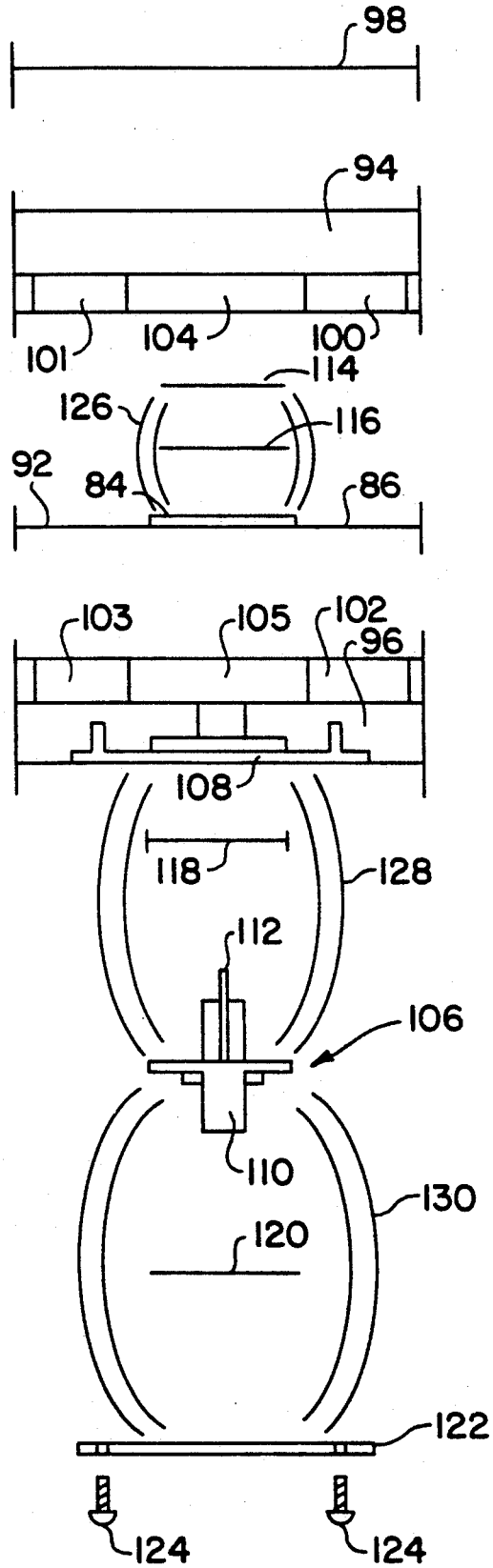
FIG. 8 is a cross-sectional view of a portion of the scanned array antenna o FIG. 6 showing details of a capacitively coupled, rotatable joint.

FIG. 8 illustrates a cross sectional view of the center portion of scanned array antenna 64 of FIG. 6 along axis Z-Z, including the transition means. The transition means includes means for capacitively coupling the signal-carrying conductor of the interconnect means with the signal-carrying conductor of the interface means and also for capacitively coupling the reference (i.e., ground) conductor of the interconnect means with the reference conductor of the interface means. Referring to FIG. 8 for more detail, support member 68 includes an upper support member 94 and a lower support member 96, both of which can be formed of an electrically conductive material, such as aluminum, or from a nonconductive material, such as plastic or structural foam, and coated with an electrically conductive material. Lower insulating sheet 80 is disposed between upper and lower support members 94 and 96. Feed patch 84, first feed segment 86 and fourth feed segment 92 are disposed on one surface of lower insulating sheet 80. The balance of interconnect network 82, shown in detail in FIG. 7, is also disposed on lower insulating sheet 80. An upper insulating sheet 98 is positioned above upper support member 94 and has parasitic elements disposed thereon. Upper channels 100 and 101 are formed in the lower surface of upper support member 94 and lower channels 102 and 103 are formed in the upper surface in lower support member 96. Together they form the channels in which first and fourth feed segments 86 and 92 are suspended. Upper channels 100 and 101 open into an upper cavity 104, formed in the lower surface of upper support member 94, which is substantially aligned over feed patch 84. Lower channels 102 and 103 open into a lower cavity 105, formed in the upper surface of lower support member 96, which is substantially aligned under feed patch 84.

Included in the interface means is a conventional coaxial connector 106 which fits in a recess 108 formed in the lower surface of lower support member 96. Coaxial connector 106 has an electrically conductive outer shell 110 which is connected to a reference potential, or ground, and surrounds a signal-carrying inner conductor 112. When assembled, inner signal-carrying conductor 112 is electrically secured, such as by soldering, to a coupling disk 114 of the transition means located between upper support member 94 and lower insulating sheet 80.

Also included in the transition means are: a first low friction layer 116 disposed between coupling disk 114 and feed patch 84; a second low friction layer 118 disposed in cavity 108 between lower support member 96 and outer shell 110 of coaxial connector 106; and a third low friction layer 120 disposed between coaxial connector 106 and a closure plate 122. When secured to lower support member 96 with screws 124 or other fasteners, closure plate 122 contains second low friction layer 118, coaxial connector 106 and third low friction layer 120 within recess 108.

Third low friction layer 120 and closure plate 122 each have a hole formed through their centers and fit onto the lower end of coaxial connector 106. Similarly, second low friction layer 118 has a hole formed through its center and fits onto the upper end of coaxial connector 106 before coaxial connector 106 is inserted into recess 108. Holes in lower insulating sheet 80, feed patch 84, first low friction layer 116 and coupling disk 114 permit them to fit onto signal-carrying conductor 112 before it is secured to coupling disk 114.

Each of first, second and third low friction layers 116, 118 and 120 are preferably disk shaped pieces of thin material having a low coefficient of friction, such as Teflon. Thus, two components separated by a low friction layer can rotate smoothly relative to each other. Additionally, each low friction layer preferably comprises a dielectric material to serve as an insulator between adjacent conducting surfaces.

In operation, a coaxial cable from a transmitter, receiver or transceiver is fastened to the interface means (e.g., coaxial connector 106). The connector and cable remain in a position which is fixed relative to the transmitter/receiver which is attached to, for example, a moving vehicle. When the vehicle changes its orientation relative to a particular satellite, it is desired that scanned array antenna 64 remain locked onto the satellite. Control module 67 activates tracking motor 65 which causes upper and lower support members 94 and 96, upper and lower insulating sheets 98 and 80, along with feed patch 84 and interconnect network 82, and enclosure plate 122 to rotate by an amount substantially equal to the rotation of the vehicle, but in the opposite direction. Coupling disk 114, which is secured to signal-carrying conductor 112 of coaxial connector 106, remains fixed relative to the vehicle. First, second and third low friction layers 116, 118 and 120 permit the components of array antenna 64 to move smoothly relative to each other.

In the transition means, coupling disk 114 and feed patch 84, separated by a low friction layer serving as a dielectric, are capacitively coupled as indicated by first field 126. Thus, a signal being carried by signal-carrying conductor 112 can be passed to feed patch 84 and the balance of interconnect network 82. The relative motion between coupling disk 114 and feed patch 84 does not substantially affect first field 126.

Similarly, the reference potential (or ground) of outer shell 110 is capacitively coupled to lower support member 96 by a second field 128. Outer shell 110 and lower support member 96 are separated by a low friction layer, serving as a dielectric. Furthermore, closure plate 122 is preferably electrically conductive causing a third field 130 to be established between outer shell 110 and closure plate 122, also separated by a low friction layer serving as a dielectric. Because capacitance is proportional to the total area of the capacitive plates, the use of capacitive plates, such as lower support member 96 and closure plate 122, on both sides of outer shell 110 increases the ground coupling (capacitance) without increasing the area of the capacitive plates or permits the area of the capacitive plates to be reduced while still maintaining satisfactory ground coupling.

Consequently, an antenna such as scanned array antenna 64, can be electromagnetically coupled to both the signal-carrying conductor and the ground conductor of a fixed feed line, such as a coaxial cable, and be rotated without relying on complicated mechanical joints which employ direct physical and electrical contact between rotating parts. Such mechanical joints are subject to wear due to friction and can introduce electrical noise when oxidation or contaminants build up between rotating parts. Thus, performance tends to degrade. However, such shortcomings are substantially reduced in the transition of the present invention which does not rely on direct physical and electrical contact between rotating parts.

It will be appreciated that the electromagnetically coupled transition described herein is not limited to a rotary joint or to a connection between a coaxial cable and an antenna. It can be used to connect lines of various types such as coaxial to coaxial, microstrip to microstrip, and combinations of these and other lines. It can also be employed when it is necessary to make a 90 degree transition or when it is difficult or undesirable to attach a feed connector to one side of a board. The latter situation might exist, for example, when a transition must be made to a microstrip transmission line (comprising a microstrip line disposed above a ground line or plane) which is sealed inside a module. A coupling disk, attached to a signal-carrying conductor, can be secured to the surface of the module closest to the internal microstrip line and a grounding disk, attached to a ground conductor, can be secured to the surface of the module closest to the internal ground line or plane. Thus, coupling can be made to the sealed module without penetrating the module.

EXAMPLE

An exemplary scanned array antenna, such as array antenna 64 illustrated in FIGS. 6 and 7, has been constructed for right-hand circular polarization in the L-band with ten EMCP pairs and aluminum support members. The driven and parasitic elements were approximately one-half wavelength copper elements, the driven element being disposed on thin mylar film and the parasitic element being disposed on a thicker polycarbonite sheet which also served as a protective radome.

Figure 9:
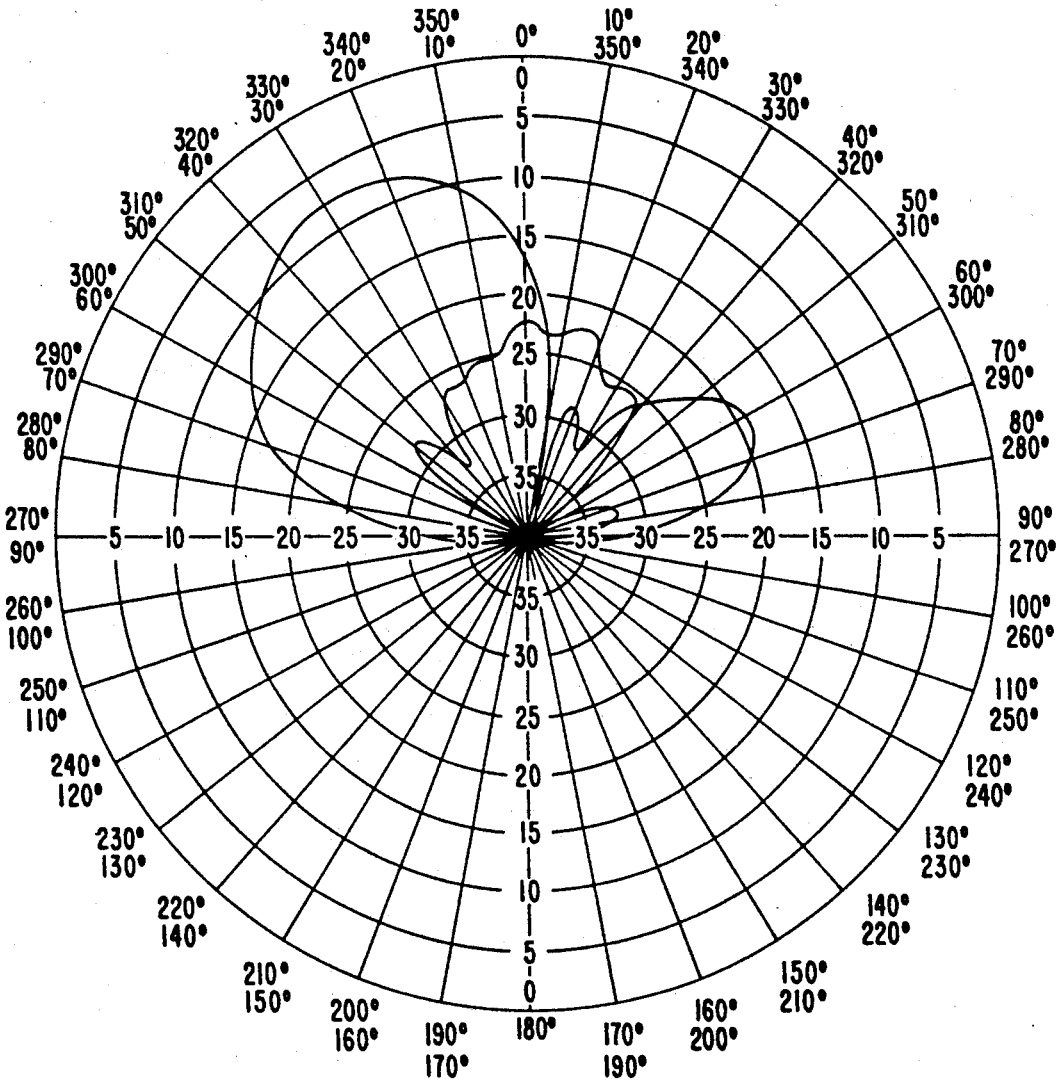
FIG. 9 is an elevation-plane antenna pattern of the scanned array antenna illustrated in FIG. 6.
Figure 10:
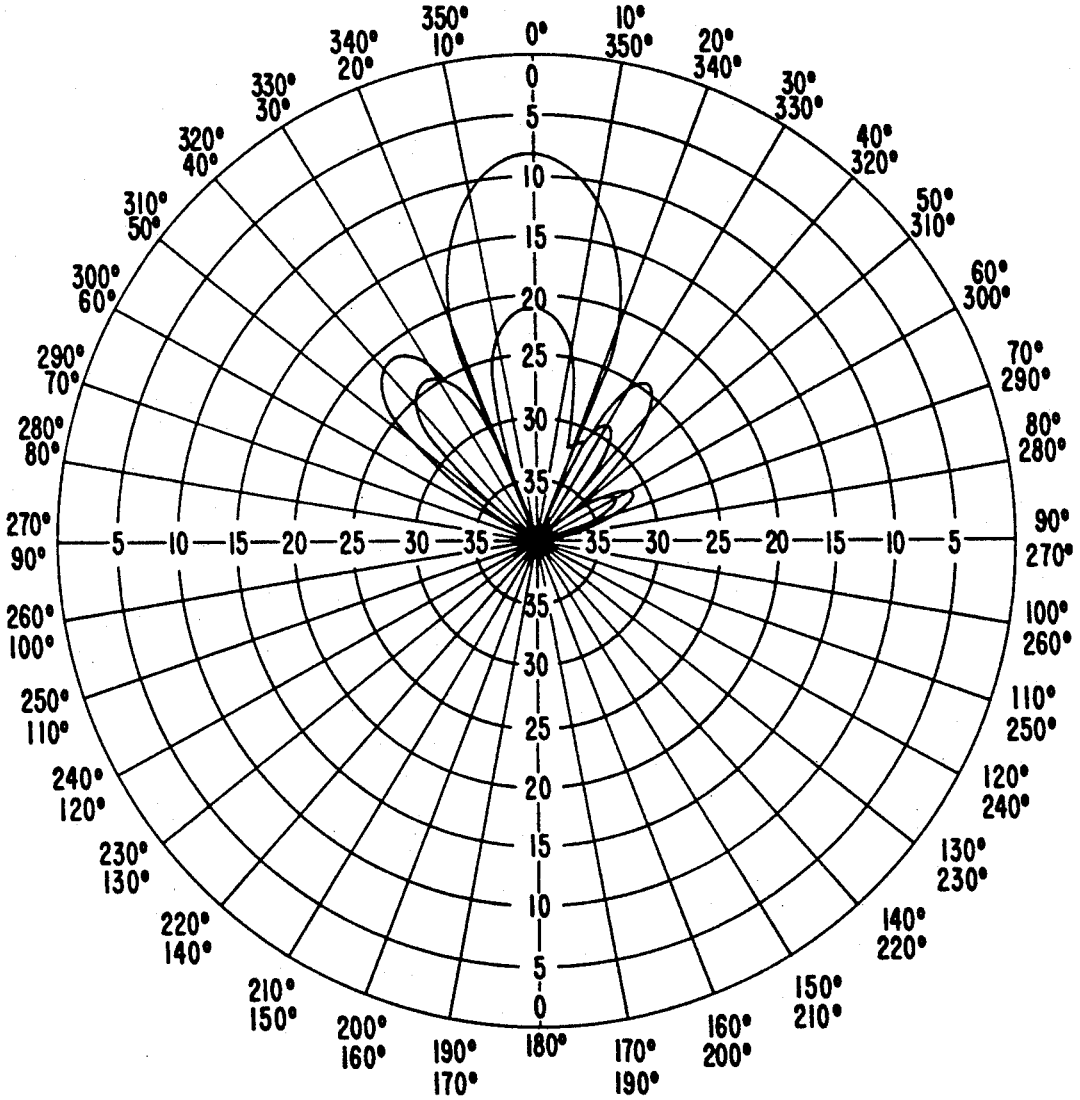
FIG. 10 is an azimuth-plane antenna pattern of the scanned array antenna illustrated in FIG. 6.
Figure 11:
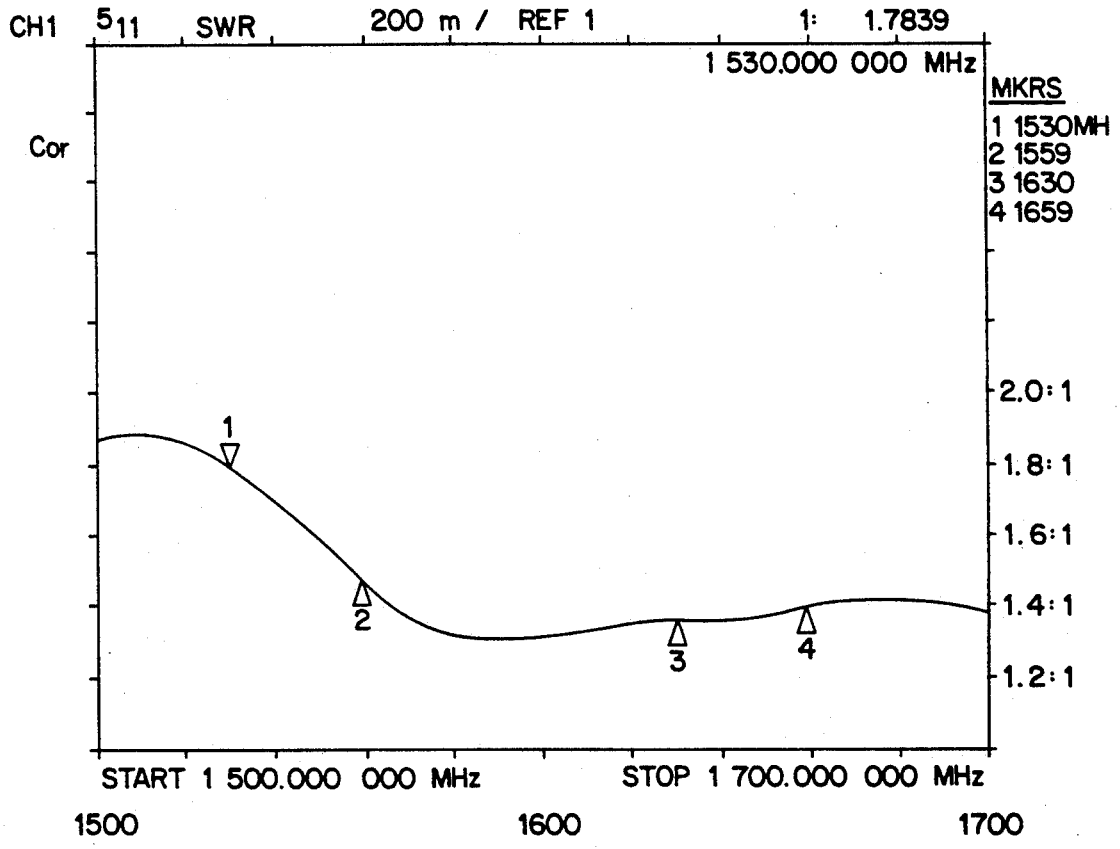
FIG. 11 is a plot of the VSWR of the scanned array antenna illustrated in FIG. 6.

FIGS. 9, 10 and 11 graphically illustrate the results of tests of the exemplary scanned array antenna. FIG. 9 illustrates an elevation-plane antenna pattern with a source transmitter having a frequency of 1560 MHz located at an azimuthal position $\Phi=0°$.

FIG. 10 graphically illustrates an azimuth-plane antenna pattern with a source transmitter having a frequency of 1560 MHz located at an elevation $0=30°$.

FIG. 11 illustrates the voltage standing wave ratio (VSWR) of scanned array antenna 64 with the frequency varying from 1500 to 1700 MHz.

These and other tests provide the following performance characteristics:

VSWR: less than about 1.6:1
Bandwidth: greater than about 10%
Gain: about 14.2 dB (typical)
Axial ratio: about 2 dB
Beam widths: azimuth: about 20°
elevation: about 38°
Peak side lobe level: azimuth: about −13 dB
elevation: about −10 dB As will be appreciated by those skilled in the art, the foregoing antenna array represents a significant advance where broad bandwidth, low mutual coupling and wide scan angle needs exist. Further, these needs can be met without sacrificing low profile capabilities.

Although the present invention has been described in detail, it should be understood that various changes, substitutions and alterations can be made herein without departing from the spirit and scope of the invention as defined by the amended claims.

What is claimed is:

1. An antenna structure, comprising:
a support member, having:
a recess formed in an upper surface; and
an electrically conductive reference surface at the bottom of said recess;
radiating means for transmitting/receiving radio frequency signals, having:
a first microstrip patch element within said recess free from contact with said support member, positioned above and substantially parallel to said reference surface and separated therefrom by a first dielectric layer;
a second microstrip patch element positioned above said first patch element and separated therefrom by a second dielectric layer said second patch element being substantially flush with said upper surface of said support member and free from contact therewith and being substantially parallel to said first patch element; and
feed means for conducting radio frequency signals to/from said radiating means, said feed means including transmission means electrically connected to one of said first and second patch elements to permit electromagnetic coupling between said first and second patch elements.

2. The antenna structure of claim 1 wherein said feed means includes:
interface means connected to said support member and adapted for electrical interconnection with transmitter/receiver means; and
interconnect means for electrically interconnecting said radiating means with said interface means.

3. The antenna structure of claim 2 wherein said interconnect means includes said transmission means, said transmission means comprising a microstrip transmission line suspended in a channel within said support member and having electrically conductive walls, said transmission line being substantially coplanar with said first patch element and interconnected thereto.

4. The antenna structure of claim 2, said antenna structure further including:

transition means interposed between said interconnect means and said interface means for permitting relative rotation therebetween.

5. The antenna structure of claim 4 wherein said transition means is adapted for permitting capacitive coupling between said interconnect means and said interface means.

6. The antenna structure of claim 5 wherein said transition means includes:

first coupling means for capacitively coupling a signal-carrying conductor of said interface means with a signal-carrying conductor of said interconnect means; and second coupling means for capacitively coupling a reference conductor of said interface means with a reference conductor of said interconnect means.

7. The antenna structure of claim 6 wherein:

said first coupling means includes:

a first electrically conductive element connected to said signal-carrying conductor of said interconnect means; and a second electrically conductive element in opposing relation to said first conductive element and separated therefrom by a first dielectric element, said second conductive element being connected to said signal-carrying conductor of said interface means; and said second coupling means includes:

a third electrically conductive element connected to said reference conductor of said interconnect means; and a fourth electrically conductive element in opposing relation to said third conductive element and separated therefrom by a second dielectric element, said fourth conductive element being connected to said reference conductor of said interface means, wherein said first and third conductive elements are rotatable relative to said second and fourth conductive elements.

8. The antenna structure of claim 7 wherein said first and second dielectric elements each include a low friction material for facilitating said relative rotation.

9. The antenna structure of claim 1 wherein:

said support member includes an upper support member and a lower support member;

said first patch element is disposed on a first insulating sheet positioned between said upper and lower support members; and said second patch element is disposed on a second insulating sheet disposed on said upper surface.

10. The antenna structure of claim 1 wherein:

said support member includes:

a plurality of recesses formed in said support member; and a plurality of electrically conductive reference surfaces, each located at the bottom of one of said plurality of recesses;

said radiating means includes:

a plurality of first patch elements each in a one-to-one corresponding relation with one of said plurality of recesses and one of said plurality of reference surfaces and each being disposed within said corresponding recess free from contact with said support member, positioned above and substantially parallel to said corresponding reference surface; and a plurality of second patch elements each in a one-to-one corresponding relation with one of said plurality of first patch elements and each being positioned above said corresponding first patch element substantially flush with said upper surface of said support member and free from contact therewith and being substantially parallel to said corresponding first patch element and electromagnetically coupled thereto; and said feed means includes:

a plurality of transmission means electrically connected to one of said plurality of first and said plurality of second patch elements to permit electromagnetic coupling between said corresponding first and second patch elements.

11. The antenna structure of claim 10, said interconnect means including said plurality of transmission means comprising a plurality of microstrip transmission lines coupled to said plurality of first patch elements, each having a selected length for providing the antenna structure with a desired scan capability.

12. The antenna structure of claim 1 wherein:

the distance between an edge of said first patch element and a wall of said recess is greater than the distance between said first patch element and said reference surface; and the distance between an edge of said second patch element and said upper surface of support member is greater than the distance between said first and second patch elements.

13. The antenna structure of claim 1 wherein:

said recess has electrically conductive walls and a flared aperture; and said upper surface of said support member is electrically conductive.

14. An antenna structure, comprising:

a support member, having:

a plurality of recesses formed in an upper surface; and a plurality of electrically conductive reference surfaces, each located at the bottom of one of said plurality of recesses;

a plurality of electromagnetically coupled patch pairs for transmitting/receiving radio frequency signals, each of said patch pairs in a one-to-one corresponding relation with one of said plurality of recesses and one of said plurality of reference surfaces and having:

a first microstrip patch element within said corresponding recess free from contact with said support member, positioned above and substantially parallel to said corresponding reference surface and separated therefrom by a first dielectric layer;

a second microstrip patch element positioned above said first patch element and separated therefrom by a second dielectric layer, said second patch element being substantially flush with said upper surface of said support member and free from contact therewith and being substantially parallel to said first patch element;

feed means for providing radio frequency signals to/from said patch pairs, including:

interface means connected to said support member and adapted for electrical interconnection with transmitter/receiver means; and interconnect means for electrically coupling said radiating means with said interface means, said interconnect means including transmission means electrically connected to one of said first and second patch elements to permit electromagnetic coupling between said first and second patch elements; and transition means interposed between said interconnect means and said interface means for permitting relative rotation therebetween.

15. The antenna structure of claim 14 wherein said transition means is adapted for permitting capacitive coupling between said interconnect means and said interface means.

16. The antenna structure of claim 15 wherein said transition means includes:

first means for capacitively coupling a signal-carrying conductor of said interface means with a signal-carrying conductor of said interconnect means; and second means for capacitively coupling a reference conductor of said interface means with a reference conductor of said interconnect means.

17. The antenna structure of claim 16 wherein:

said first coupling means includes:

a first electrically conductive element connected to said signal-carrying conductor of said interconnect means; and a second electrically conductive element in opposing relation to said first conductive element and separated therefrom by a first dielectric element, said second conductive element being connected to said signal-carrying conductor of said interface means; and said second coupling means includes:

a third electrically conductive element connected to said reference conductor of said interconnect means; and a fourth electrically conductive element in opposing relation to said third conductive element and separated therefrom by a second dielectric element, said fourth conductive element being connected to said reference conductor of said interface means, wherein said first and third conductive elements are rotatable relative to said second and fourth conductive elements.

18. The antenna structure of claim 17 wherein said first and second dielectric elements each include a low friction material for facilitating said relative rotation.

19. The antenna structure of claim 14 wherein:

said support member includes an upper support member and a lower support member;

said first patch elements are disposed on a first insulating sheet disposed between said upper and lower support members; and said second patch elements are disposed on a second insulating sheet disposed on said upper surface.

20. The antenna structure of claim 19 wherein said transmission means comprises a plurality of microstrip transmission lines suspended in a channel with said support structure and having electrically conductive walls, said plurality of transmission lines being disposed on said first insulating sheet substantially coplanar with said first patch elements.

21. The antenna structure of claim 14 wherein:

the distance between an edge of each said first patch element and a wall of said corresponding recess is greater than the distance between each said first patch element and said corresponding reference surface; and the distance between an edge of each said second patch element and said upper surface of support member is greater than the distance between corresponding first and second patch elements.

22. The antenna structure of claim 14 wherein:

each of said plurality of recesses has electrically conductive walls and a flared opening; and said upper surface of said support member is electrically conductive.

23. A scanned array antenna structure, comprising:

an upper support member having a plurality of openings formed therethrough, each of said openings having electrically conductive walls and a flared upper aperture;

a lower support member having:

a plurality of recesses formed in a upper surface, each in substantial registration with one of said plurality of openings and having electrically conductive walls; and a plurality of electrically conductive reference surfaces, each located at the bottom of one of said plurality of recesses;

a plurality of electromagnetically coupled patch pairs for transmitting/receiving radio frequency signals, each of said patch pairs in a one-to-one corresponding relation with one of said plurality of openings, one of said plurality of recesses and one of said plurality of reference surfaces and having:

a first dielectric layer above said corresponding reference surface with said corresponding recess;

a first insulating sheet positioned between said upper and lower support members and above said corresponding reference surface within said corresponding recess, said first insulating sheet being separated from said corresponding reference surface by said first dielectric layer;

a driven element disposed on said first insulating sheet free from contact with said upper and lower support members and substantially parallel to said corresponding reference surface;

a second insulating sheet positioned on an electrically conductive upper surface of said upper support member above an aperture of said corresponding opening, said second insulating sheet being separated from said first insulating sheet by a second dielectric layer; and an parasitic element disposed on said second insulating sheet substantially flush with said upper surface of said upper support member and free from contact therewith, said parasitic element being substantially parallel to said driven element;

feed means for providing radio frequency signals to/from said plurality of patch pairs, comprising:

interface means connected to said upper and lower support members and adapted for electrical interconnection with transmitter/receiver means; and interconnect means for electrically coupling said driven elements with said interface means, said interconnect means being electrically connected to said driven elements to permit electromagnetic coupling between said driven elements and said parasitic elements; and transition means interposed between said interconnect network and said interface means for permitting relative rotation therebetween.

24. The antenna structure of claim 23 wherein said interconnect means includes a plurality of signal-carrying microstrip transmission lines suspended in a channel disposed within said upper and lower support members and having electrically conductive reference walls, said plurality of transmission lines being disposed on said first insulating sheet substantially coplanar with said driven elements.

25. The antenna structure of claim 24 wherein said plurality of transmission lines have selected lengths for providing the antenna structure with a desired scan capability.

26. The antenna structure of claim 25 wherein said transition means includes:

first means for capacitively coupling a signal-carrying conductor of said interface means with said one or more microstrip transmission lines of said square-ax interconnect network; and second means for capacitively coupling a reference conductor of said interface means with said reference walls of said square-ax interconnect network.

27. The antenna structure of claim 26 wherein:

said first coupling means includes:

a first electrically conductive element connected to said signal-carrying conductor of said interconnect means; and a second electrically conductive element in opposing relation to said first conductive element and separated therefrom by a first dielectric element, said second conductive element being connected to said signal-carrying conductor of said interface means; and said second coupling means includes:

a third electrically conductive element connected to said reference conductor of said interconnect means; and a fourth electrically conductive element in opposing relation to said third conductive element and separated therefrom by a second dielectric element, said fourth conductive element being connected to said reference conductor of said interface means, wherein said first and third conductive elements are rotatable relative to said second and fourth conductive elements.

28. The antenna structure of claim 27 wherein said first and second dielectric elements each include a low friction material for facilitating said relative rotation.

29. The antenna structure of claim 24 wherein:

the distance between an edge of each said driven element and said wall of said corresponding recess is greater than the distance between each said driven element and said corresponding reference surfaces; and the distance between an edge of each said parasitic element and said upper surface of said upper support member is greater than the distance between said driven and parasitic elements.

* * * * *